US006257438B1

(12) United States Patent
von Holdt, Jr.

(10) Patent No.: US 6,257,438 B1
(45) Date of Patent: Jul. 10, 2001

(54) CONTAINER CONSTRUCTION

(76) Inventor: John W. von Holdt, Jr., 3121 Mary Kay La., Glenview, IL (US) 60025

( * ) Notice: Subject to any disclaimer, the term of this patent is extended or adjusted under 35 U.S.C. 154(b) by 0 days.

(21) Appl. No.: 09/500,621

(22) Filed: Feb. 9, 2000

Related U.S. Application Data

(63) Continuation-in-part of application No. 09/106,485, filed on Jun. 29, 1998, now Pat. No. 6,098,833, which is a continuation-in-part of application No. 08/823,193, filed on Mar. 24, 1997, now Pat. No. 5,913,446, which is a continuation-in-part of application No. 08/798,511, filed on Feb. 10, 1997, now abandoned, which is a continuation-in-part of application No. 08/707,746, filed on Sep. 4, 1996, now abandoned, which is a continuation-in-part of application No. 08/262,916, filed on Jun. 21, 1994, now abandoned.

(51) Int. Cl.[7] ..... B65D 1/46
(52) U.S. Cl. ..... 220/659; 220/656
(58) Field of Search ..... 220/659, 658, 220/657, 656, 675, 672, 670, 780, 782, 4.05, 606, 605, 604

(56) References Cited

U.S. PATENT DOCUMENTS

| | | | | |
|---|---|---|---|---|
| 2,335,260 | * | 11/1943 | Chamberlain . | |
| 3,915,330 | * | 10/1975 | Hammes et al. | 220/659 |
| 4,177,934 | | 12/1979 | Hammes et al. . | |
| 4,197,958 | | 4/1980 | Zeni et al. . | |
| 4,293,080 | | 10/1981 | Letica . | |
| 4,367,821 | | 1/1983 | Holt . | |
| 4,429,805 | | 2/1984 | Letica . | |
| 4,610,351 | * | 9/1986 | Coles et al. | 206/217 |
| 5,249,694 | | 10/1993 | Nelson . | |
| 5,913,446 | * | 6/1999 | Holdt, Sr. et al. | 220/659 |
| 6,098,833 | * | 8/2000 | von Holdt, Sr. et al. | 220/659 |

* cited by examiner

*Primary Examiner*—Stephen Castellano
(74) *Attorney, Agent, or Firm*—Banner & Witcoff, Ltd.

(57) ABSTRACT

A molded plastic bucket or container includes an open end with a hoop member having a variable radius positioned at the open end in combination with an upper radial rib to provide enhanced stacking and hoop strength.

14 Claims, 4 Drawing Sheets

FIG.1
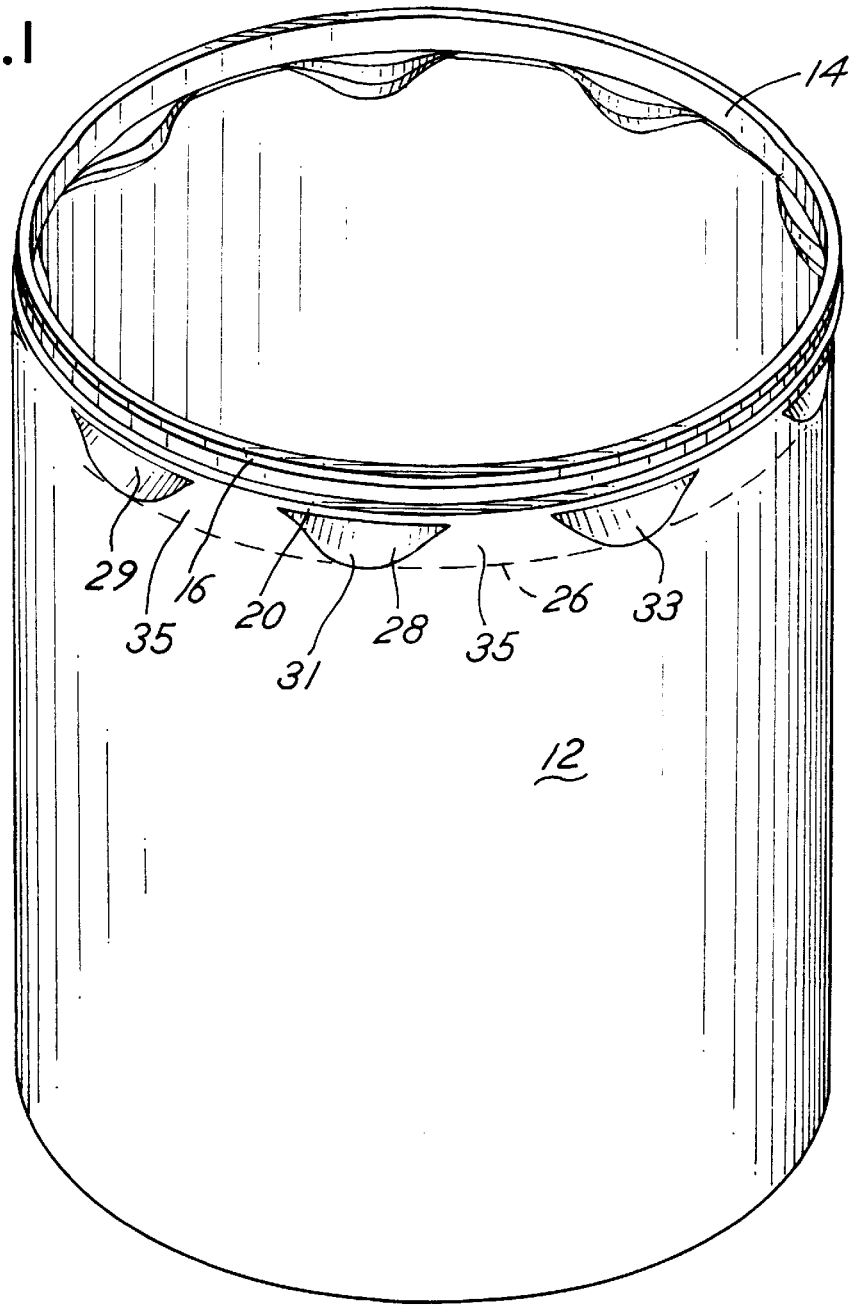
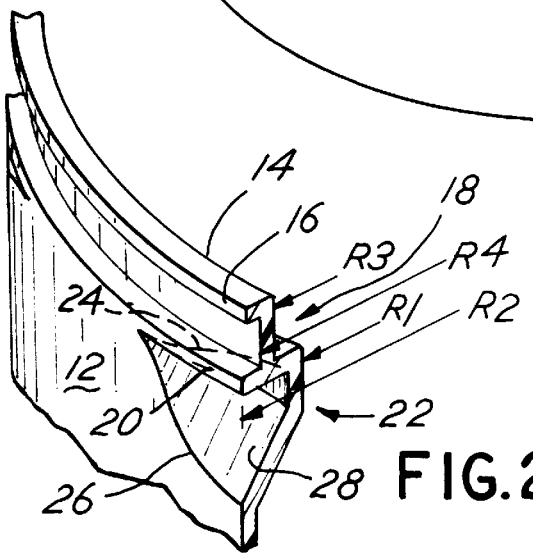
FIG.2

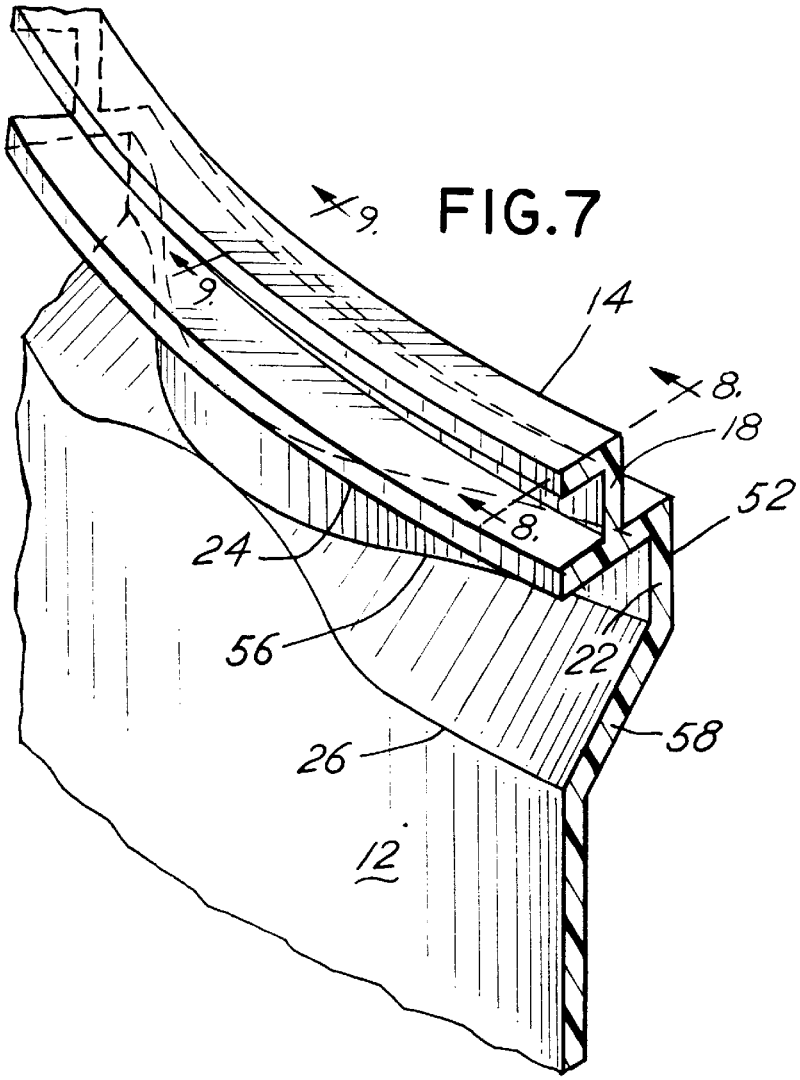
FIG.7
FIG.8
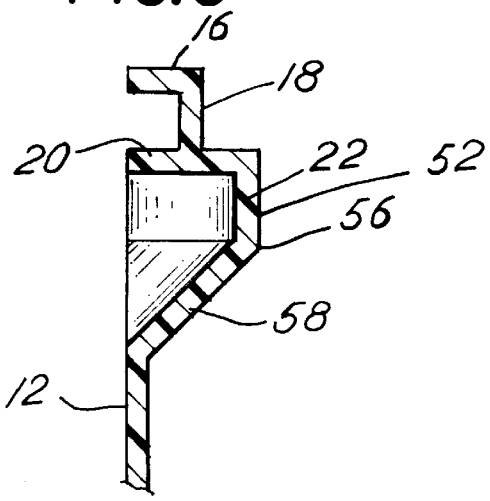
FIG.9
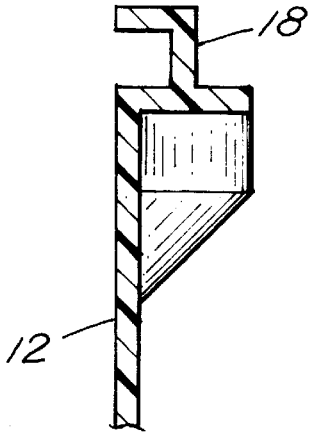

CONTAINER CONSTRUCTION

CROSS-REFERENCE TO RELATED APPLICATIONS

This application is a continuation-in-part of U.S. Ser. No. 09/106,485, filed Jun. 29, 1998, now U.S. Pat. No. 6,098,833, which is a continuation-in-part of U.S. Ser. No. 08/823,193, filed Mar. 24, 1997, now U.S. Pat. No. 5,913,446, issued Jun. 22, 1999, which is a continuation-in-part of U.S. Ser. No. 08/798,511, filed Feb. 10, 1997, now abandoned, which is a continuation-in-part of U.S. Ser. No. 08/707,746, filed Sep. 4, 1996, now abandoned, which is a continuation-in-part of U.S. Ser. No. 08/262,916, filed Jun. 21, 1994, now abandononed, all incorporated herewith by reference.

BACKGROUND OF THE INVENTION

The present invention relates to a molded plastic container, bucket or pail construction of the type including a bottom wall with an integrally molded, side wall and an open top end wherein the open top end is formed with various integral molded hoops and ribs to enhance the stacking capability of the pail or bucket and to facilitate maintenance of the shape of the bucket. The design is especially usefull when incorporated in a cylindrical or circular cross section bucket or container.

Heretofore there have been various proposed constructions for molded plastic buckets or containers used for holding paint, chemicals and other materials. For example, the following patents disclose a molded plastic bucket construction wherein the bucket has an open top end:

| Patent No. | Title | Inventor | Date |
|---|---|---|---|
| 4,177,934 | Container and Lid | Hammes et al. | Dec. 11, 1979 |
| 4,197,958 | Container of Foamed Thermoplastic Material | Zeni et al. | April 15, 1980 |
| 4,293,080 | Container Construction | Letica | Oct. 6, 1981 |
| 4,367,821 | Paint Pail With Depending Skirt for Label Attachment | Holt | Jan. 11, 1983 |
| 4,429,805 | Container Construction | Letica | Feb. 7, 1984 |
| 5,249,694 | Tear Strip Container | Nelson | Oct. 5, 1993 |

Constructions of this general type are usefull and, to some extent, have been commercially adopted. However, there has remained a desire to provide a simplified construction of the open or top end of such a bucket wherein the bucket can be fabricated using simplified molds while retaining the necessary stacking strength and meet other structural requirements. Of particular interest is a bucket construction which eliminates complex reinforcing ribs, vanes, fillets and the like.

SUMMARY OF THE INVENTION

In a principal aspect, the present invention comprises a molded plastic bucket or container of the type including a bottom wall integrally molded with a side wall extending upwardly from the bottom wall, the side wall terminating at an open top which is adapted to receive and engage with a lid to close the container so that the closed container will retain paint, liquid or other material. In a preferred embodiment, the open top includes an integrally molded upper, cylindrical first hoop having first and second, vertically spaced, generally horizontal projecting ribs. Typically, the first or uppermost rib projects laterally outwardly in a horizontal direction from the vertical wall section defining the first hoop. The second rib is spaced downwardly from the first rib and also projects laterally outwardly or inwardly, or both outwardly and inwardly from the first hoop.

The open end further includes a second integrally molded wall section or second hoop positioned between the second rib and the adjacent side wall of the bucket. The second hoop has a radius which varies about the circumference of the second hoop. In a preferred embodiment, the variation of the radius of the second hoop is characterized by a sinusoidal or corrugated shape in plan view, although other variable patterns may be adopted. By varying the radius and thus varying the plan configuration of the second hoop, the stacking strength as well as the hoop strength of the bucket may be enhanced. Thus, it is possible to control the stacking strength of the container and the hoop strength of the open end of the container in a manner which does away with a requirement for additional ribs, vanes or other reinforcing members molded into the container side wall. The thickness of the second hoop may also be varied about the circumference of the bucket to provide additional strength and rigidity characteristics, particularly at the upper end of the bucket or container.

The utilization of both first and second hoops is not essential since the first uniform radius hoop may be eliminated and a variable configuration hoop alone may be adopted.

Thus, it is an object of the invention to provide an improved molded plastic bucket or container having a specialized construction associated with the open end of the bucket to enhance the hoop and stacking strength of the bucket.

A further object of the invention is to provide an improved molded plastic bucket which may be easily manufactured with appropriate mold elements.

Another object of the invention is to provide a molded plastic bucket construction which utilizes a minimum amount of mold material yet which provides maximum container strength and volume.

These and other objects, advantages and features of the invention will be set forth in a detailed description which follows.

BRIEF DESCRIPTION OF THE DRAWING

In the detailed description which follows, reference will be made to the drawing comprised of the following figures:

FIG. 1 is an isometric view of a first embodiment of a molded plastic bucket incorporating the features of the invention;

FIG. 2 is an enlarged cut-away isometric view of the top open end of the molded plastic bucket of FIG. 1;

FIG. 7 is an isometric view of a second embodiment of the invention;

FIG. 8 is an enlarged cross sectional view of the open end construction of the embodiment of FIG. 7 taken along the line 8—8; and FIG. 9 is an enlarged cross sectional view of the open end construction of the embodiment of FIG. 7 taken along the line 9—9.

DESCRIPTION OF THE PREFERRED EMBODIMENT

Figure 3:
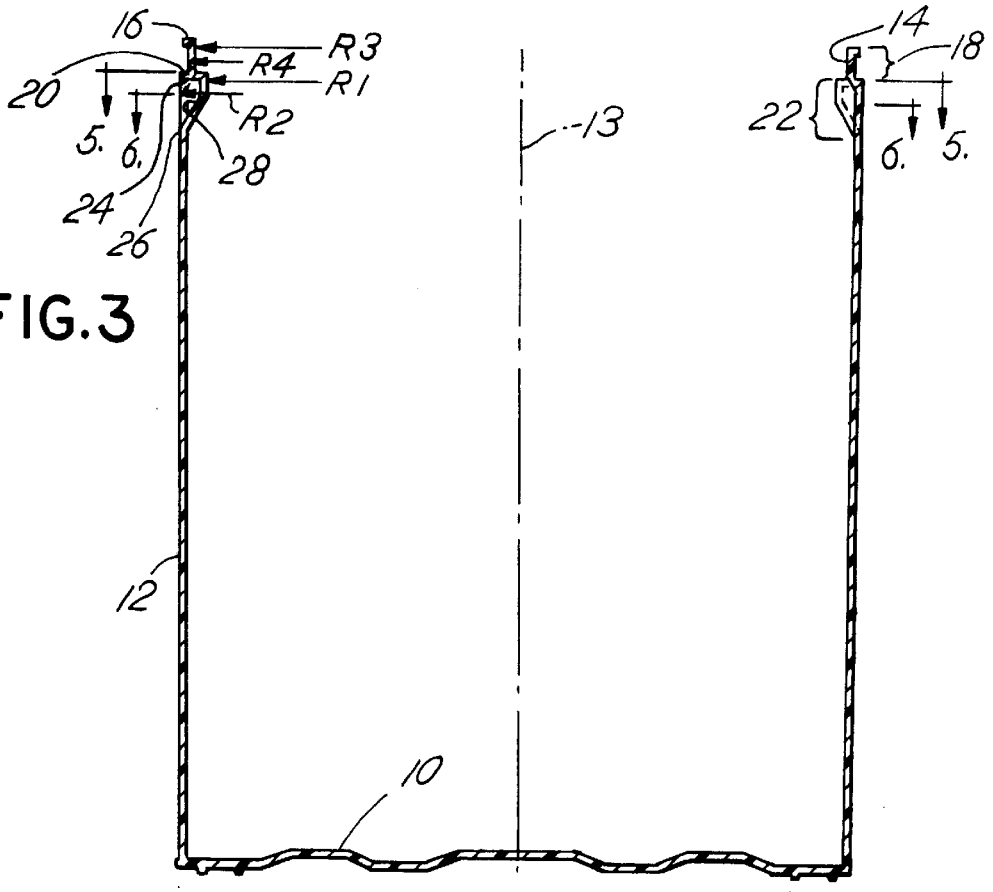
FIG. 3 is a side elevation cross sectional view of the bucket of FIG. 1.
Figure 4:
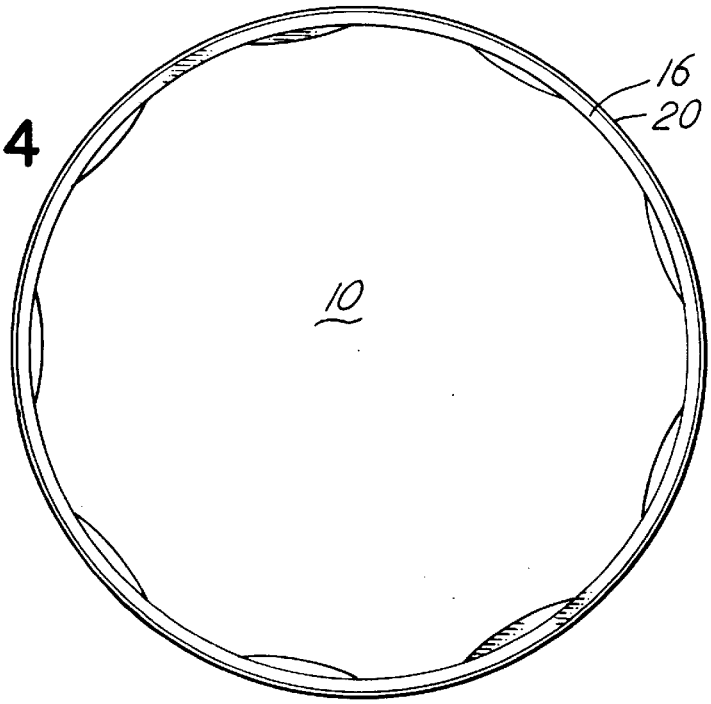
FIG. 4 is a plan view of the bucket of FIG. 3.
Figure 5:
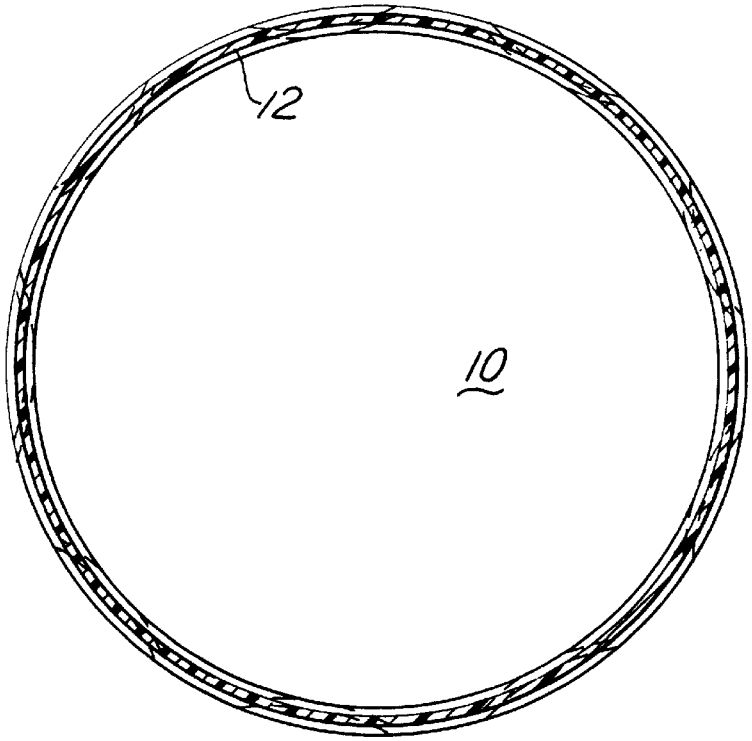
FIG. 5 is a cross sectional view of the bucket of FIG. 3 taken along the line 5—5.

A first embodiment of a container, bucket or pail incorporating the invention is depicted in FIGS. 1–6. Typically, a bucket of the type depicted is molded from a plastic material, for example, as a one-gallon size bucket or container for paint or other fluids. However, the size and contents of the molded bucket are not limiting features of the invention, and thus the bucket, as depicted in FIG. 1, is merely exemplary of a bucket which incorporates the invention. The cross sectional configuration of the described bucket is typically circular. The invention is, however, applicable to any configuration of container having an enclosed side wall including containers having non-circular sections.

Referring to the embodiment of FIGS. 1–6, the bucket or container includes a bottom wall 10 with an integrally molded side wall 12. Typically the side wall 12 is molded with a cylindrical or truncated cylindrical shape. That is, the diameter or radius of the side wall 12 will typically increase as one traverses the side wall vertically from the bottom wall 10 toward an open top end 14. This enables the diameter of the container at the lower end of the wall 12 to be lesser than the diameter at the upper or top end 14. As a consequence, the lower end of the side wall 12 and the bottom wall 10 of the bucket will fit within a profile defined by the upper end 14 and thus facilitate stacking of buckets of the type disclosed. Consequently, the lower end or bottom wall 10 may fit within and on top of a lid affixed to the open top end 14. Further, by having a draft or tapered or truncated cylindrical side wall 12, the molding or container manufacturing operation is facilitated. For example, removal of an internal cope from a mold used to make the bucket is facilitated.

The bucket typically is molded as a single unit. The subject matter of the invention relates in particular to the construction of the open, top end 14 of the bucket. The open, top end 14, in a preferred embodiment, includes a first, or uppermost horizontal, radially outwardly extending first rib 16 which is integrally molded with a circumferential, first, circular hoop 18. The first hoop 18 defines a generally vertical wall which is generally parallel to the center line axis 13 of the container and has a diameter equal to or less than the diameter of the upper end of side wall 12. The first rib 16, comprises an outwardly, horizontally extending member with a surface against which a lid or top closure element (not shown) may be fastened or attached.

The first hoop 18 preferably has a uniform inner radius R3 about its inner circumference which is lesser than the inner radius of side wall 12. Alternatively, radius R3 may be less than the outermost radius of side wall 12. The lower edge of the first hoop 18 connects with a second, circumferential flange or rib 20. The second rib 20 is generally parallel to the first rib 18 and comprises an horizontal rib 20 which is integrally molded with the first hoop 18. Preferably the first hoop 18 is attached to the second rib 20 intermediate the radial dimensions defining the second rib 20. That is, the second rib 20 typically includes a variable internal radius R1 and a uniform external radius R2. The difference between the radii R1 and R2 defines the annular shape of the second rib 20. The annular shape is uniform about the outer circumference of the rib 20 and varies between radius R1 and R3 on the inside circumference of rib 20. However, both the inner radius R1 and outer radius R2 may be varied about the circumference of rib 20 or maintained as constants.

In any event, the first hoop 18 has an inner radius R3 which is typically uniform and dimensionally intermediate the radii R1 and R2 of rib 20. Of course, first hoop 18 has a thickness and thus, an outer radius R4. Generally, the thickness of first hoop 18 is also uniform and greater than or equal to the thickness of the side wall 12.

Integrally molded with and connected to the second rib 20 is a second circumferential hoop 22. The second circumferential hoop 22 is characterized by a shape which extends entirely about the circumference of the bucket side wall 12, and which has a radial dimension measured from axis 13 that varies about the bucket circumference as well as vertically. In the embodiment depicted, the radius of second hoop 22 varies between that of the limits defined by the second rib 20; that is, the radii of the second hoop 22 vary between radial dimensions R1 and R2. However, the variability of the radius of the second hoop 22 may be greater or lesser than the variance of radii R1 and R2.

Figure 6:
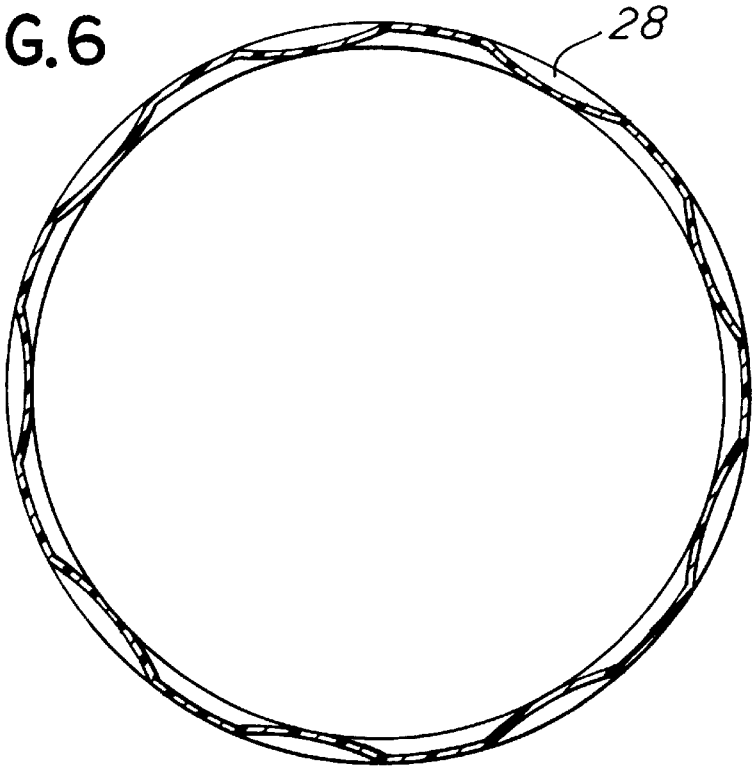
FIG. 6 is a cross sectional view of the bucket of FIG. 3 taken along the line 6—6.

The second hoop 22 includes a top edge 24 integrally molded into the bottom of the second rib 20. Top edge 24 defines a pattern in plan view as depicted in FIG. 6. The second hoop 22 further includes a bottom edge 26 which is preferably spaced a uniform vertical distance from and parallel to the top edge 24. Note however, the bottom edge 26 may have variable spacing from top edge 24 about the circumference of second hoop 22. In any event, the bottom edge 26 is substantially congruent with the cylindrical cross section side wall 12 (see FIG. 1).

Second rib 20 is connected by a transition section 28 and a wall continuation section 35 to the cylindrical side wall 12. Since the radius of the top edge 24 and the bottom edge 26 vary with respect to each other about the circumference of the second hoop 22, the bucket includes a series of spaced indentations or scallops 29, 31, 33 about the circumference of the wall 12. Intermediate each indentation or scallop, e.g., 29, 31, is a smooth continuation section 35 of wall 12. The effect of wall continuation sections 35 is to enhance or maintain the stacking strength of the container. The scallops 29, 31, 33, and more particularly, the combination of transition sections 28 with continuation sections 35 enhance the hoop strength of the container adjacent the open end 14.

In the embodiment shown, the thickness of the second hoop 22 in a radial direction is uniform and is equal to the thickness of the first hoop 18 or the thickness of the cylindrical side wall 12. However, the thickness of the second hoop 22 may be distinct from that of first hoop 18 and/or wall 12 and may also be variable about its circumference. The radial extent of the second hoop 22 inwardly and outwardly may thus be variable and the second hoop 22 may have sections with a radius less than R1 and/or greater than R2 in the embodiment depicted.

The periodicity of the variability of the radius of second hoop 22 may also be altered. In the embodiment of FIGS. 1–6, the periodicity is generally uniform and defines a shape in plan view at the intersection of second rib 20 and second hoop 22 which is a sinusoidal or a corrugated pattern (FIG. 6). Other patterns including patterns defining various polygonal shapes may be used. Also, the variation may be non-periodic and the thickness of hoop 22 may be variable in a periodic or non-periodic manner about the circumference of hoop 22. Further, the thickness of the connection section 28 is depicted as being equal to the thicknesses, for example, of the first hoop 18 or second hoop 22 or wall 12. The thickness of connection section 28, however, may also be variable and distinct from that of first hoop 18, second hoop 22 and/or wall 12.

In review, the radius of the second hoop 22 is varied or may be varied both horizontally and vertically with respect to axis 13.

FIGS. 7–9 depict another embodiment wherein a second hoop 52 has a vertical run with a uniform cross section and a transition scallop 58 connects a bottom edge 56 of hoop 52 to side wall 12. It is also possible to eliminate the first hoop 18 and just utilize a sinusoidal or variable pattern second hoop 22 (of the type depicted in FIGS. 1–6 or FIGS. 7–9) in combination with a circumferential rib, such as second rib 20.

It is to be noted that a container lid (not shown) may include a peripheral skirt with an inwardly projecting, annular flange to grip against the first rib 16. The lid may further include additional inwardly projecting flanges (not shown) which fit into the pockets defined by the scallop recesses 29, 31 and 33 defined by the second hoop 22. The additional flanges (not shown) may thus function as supplemental hook members to retain a lid on a container.

The construction of the open top or end of a container as described is typically cylindrical. However, other open end shapes and container shapes are within the scope of the invention. Further, additional hoops of variable plan view configuration may be molded at the top or open end of the container. The thickness of any hoop may be varied about the circumference of the hoop. The thickness of the second rib 20 is typically uniform though it too may be variable about the circumference thereof. The radii of the ribs 18, 20 may be variable about their circumference. Other variations of the construction described are possible. Thus the invention is to be limited only by the following claims and equivalents thereof.

What is claimed is:

1. A molded plastic container comprising, in combination:

a bottom wall; and a side wall extending upwardly from the bottom wall to define an enclosure with an open top end;

said open top end including a first, uniform radius, circumferential hoop at the top end with a radially outwardly projecting circumferential first rib extending from the first hoop;

a section radially outwardly extending rib projecting from the first hoop, said second rib spaced from the first rib toward the bottom wall; and a circumferential, second hoop having upper and lower circumferential edges, said second hoop connected to the second rib along the upper edge of the second hoop and to the container side wall along the lower edge, said second hoop having a variable radius about the circumference of the second hoop to define a sinusoidal plan profile.

2. The container of claim 1 wherein the radius of the second hoop is variable about the circumference of the second hoop to define a sinusoidal plan profile of the second hoop.

3. The container of claim 1 wherein the container side wall adjacent the second hoop has a uniform inner radius about the circumference of the side wall, the first hoop has a inner, uniform lesser radius, and the second hoop has a variable inner radius.

4. The container of claim 3 wherein the variable inner radius of the second hoop varies between the inner radius of the side wall and a radius less than the inner radius of the first hoop.

5. The container of claim 1 wherein the second rib has an inner radius and an outer radius and wherein the first hoop extends upwardly from the second rib intermediate the inner and outer radius of the second rib.

6. The container of claim 1 wherein the second rib has an inner radius and an outer radius and wherein the second hoop has a radius which varies between said inner and outer radius of said second rib.

7. The container of claim 1 wherein the radius of the second hoop is variable vertically and horizontally.

8. A molded plastic container comprising, in combination:

a bottom wall;

a side wall extending upwardly from the bottom wall to define an enclosure with an open top;

a circumferential hoop at the open top with a variable radius having a sinusoidal plan profile, said hoop including a top edge and a bottom edge;

a side wall connection second between the hoop bottom edge and the side wall; and a first radial rib of substantially uniform outer radial extent connected to the top edge of said hoop.

9. The container of claim 8 wherein the first rib has a radial dimension at least equal to the maximum radius of the hoop.

10. The container of claim 8 wherein the first rib extends radially outwardly from the hoop.

11. The container of claim 8 further including a second radial rib spaced upwardly from the first radial rib and connected thereto by a second circumferential hoop.

12. The container of claim 11 wherein the second rib extends radially outwardly from the second circumferential hoop.

13. The container of claim 11 wherein the second rib is at the extreme top of the open end of the container and defines a flange for cooperation with a lid.

14. The container of claim 11 wherein the second hoop has a uniform radius.

* * * * *